US011525571B2

(12) United States Patent
Zaiser et al.

(10) Patent No.: US 11,525,571 B2
(45) Date of Patent: Dec. 13, 2022

(54) STEAM INJECTION HEATER WITH INTEGRATED CLEANING MECHANISM

(71) Applicant: Hydro-Thermal Corporation, Waukesha, WI (US)

(72) Inventors: James C. Zaiser, Elm Grove, WI (US); Sean A. O'Rear, Wauwatosa, WI (US); Fredrick L. Kottke, Lisbon, WI (US)

(73) Assignee: Hydro-Thermal Corporation, Waukesha, WI (US)

( * ) Notice: Subject to any disclaimer, the term of this patent is extended or adjusted under 35 U.S.C. 154(b) by 399 days.

(21) Appl. No.: 16/864,330

(22) Filed: May 1, 2020

(65) Prior Publication Data

US 2020/0348019 A1 Nov. 5, 2020

Related U.S. Application Data

(60) Provisional application No. 62/842,115, filed on May 2, 2019.

(51) Int. Cl.
*F22B 37/52* (2006.01)
*F28C 3/08* (2006.01)

(52) U.S. Cl.
CPC ..... *F22B 37/52* (2013.01); *F28C 3/08* (2013.01)

(58) Field of Classification Search
CPC ..... F22B 37/52; F28C 3/08
See application file for complete search history.

(56) References Cited

U.S. PATENT DOCUMENTS 2,483,426 A * 10/1949 Moore ..... B01F 25/312 137/98
5,743,638 A * 4/1998 Cummins ..... F28C 3/08 366/150.1
6,076,809 A * 6/2000 Cummins ..... F28C 3/08 261/76

(Continued)

FOREIGN PATENT DOCUMENTS

CA 2461607 A1 9/2004
EP 1462747 A2 9/2004

OTHER PUBLICATIONS

International Search Report and Written Opinion for International Application No. PCT/US2020/030928 dated Jul. 23, 2020.

*Primary Examiner* — Nathaniel Herzfeld
(74) *Attorney, Agent, or Firm* — Andrus Intellectual Property Law, LLP

(57) ABSTRACT

A direct contact steam injection heater that includes a stem plug that is rotatable over 360°. The stem plug is connected to an actuator that is operable to rotate the stem plug over 360° of rotation during both the heating function of the steam injection heater and during a clean-in-place process. The stem plug includes a regulating head having a pair of sealing inserts formed on each of a pair of sealing faces. The sealing inserts are biased outward into contact with an inner surface that includes the steam injection nozzles. As the regulating head rotates between a closed position and an open position, the nozzles are exposed to allow steam to flow into the product being heated. The regulating head further includes a pair of foils. During the clean-in-place operation, the foils create a turbulent flow of cleaning liquid within the steam chamber.

17 Claims, 8 Drawing Sheets

(56) References Cited

U.S. PATENT DOCUMENTS

| | | | | |
|---|---|---|---|---|
| 6,082,712 | A * | 7/2000 | Cincotta | B01F 25/3122 261/76 |
| 6,361,025 | B1 | 3/2002 | Cincotta et al. | |
| 7,025,338 | B2 * | 4/2006 | Cincotta | B01F 35/718051 261/77 |
| 7,621,512 | B2 * | 11/2009 | Brockmann | A23L 3/22 422/26 |
| 2015/0342207 | A1 * | 12/2015 | Doring | A23C 3/037 426/474 |

* cited by examiner

STEAM INJECTION HEATER WITH INTEGRATED CLEANING MECHANISM

CROSS REFERENCE TO RELATED APPLICATION

The present application is based on and claims priority to U.S. Provisional Patent Application Ser. No. 62/842,115, filed May 2, 2019, the disclosure of which is incorporated herein by reference.

BACKGROUND

According to the currently accepted standards for 3-A, the steam side of a steam injection heater does not require cleaning after processing of foods with direct steam injection. Perhaps this is due to lack of understanding of the operation of steam injection, but the reality of this process is that food liquids and particles do actually enter the steam side of the steam injection heater under normal processing. It is recognized that steam sterilizes the steam side of a steam injection heater for control of vegetative pathogenic and spoilage microorganisms. Perhaps this is the reason for the misconception that this area need not be cleaned. However, there are allergens that can survive steam temperatures for extended durations to create allergic responses in people and animals. For instance, peanut proteins can survive relatively high temperatures indefinitely and still cause an allergic response. For this reason, cleaning (removal of food residues and particles) is critical in direct steam injection heaters used to prepare foods.

All steam injection heaters, even internally modulated steam injectors, such as from Hydro-Thermal Corporation, have no physical barrier between the steam and product sides of the device. The only force that prevents food from entering the steam side of the device is the pressure of the steam itself. The steam must be a higher pressure than the food to prevent the flow of food into the steam side, which is very difficult for steam spargers as they operate at steam pressures very close to the food pressure. This leads to operating states where food residues are trapped in the steam side of the injector, with no possibility to clean for allergen control.

Some individual complete food processing systems integrating steam injection heaters have been designed and are on the market that incorporate cleaning loops for the steam side of the injector, but no injectors on the market are built with cleaning mechanisms that create highly hygienic steam side designs.

The Infuze cooker from Hydro-Thermal Corporation is the first commercially available direct steam injection heater to integrate a cleaning mechanism directly into the steam side of the injector itself to insure optimal mechanical cleaning.

The fixed orifice areas in internally modulated steam injection heaters provides for excellent heating control and repeatability, but provides restrictions in generating 1.5 m/s (5 ft/s) velocities for clean-in-place (CIP) applications. This reduces the cleaning capabilities of the steam side of the injector significantly, and produces equipment that potentially can not be validated through the cleaning process.

The 1.5 m/s flowrate is generally accepted in the food and beverage industry as the minimum flowrate to generate turbulent flow. This flow regime is required to produce mechanical action to the cleaning process of piped systems. Without this velocity minimum, it is not recognized as a cleanable design. In lieu of the ability to generate these standard velocities through fixed orifice designs, a mechanical solution was created in the form of a 360° spinning stem plug in accordance with the present disclosure. In this design, the stem plug operates as a normal quarter-turn modulating injector for steam heating control. However, when the injector is in a cleaning mode, the stem plug can freely spin in either the clock-wise or counter-clockwise direction about a full 360°. The speed at which the stem plug can spin is not fixed, but instead is matched to the turbulent flow needs of the material to be cleaned from the injector. Thus, power consumption can be reduced by rotating at 2 rpm for easy to clean materials, or spin at 60 rpm for more aggressive materials.

SUMMARY

A standard and common quarter-turn actuator is insufficient in many ways to meet the needs of this cleaning duty. These actuators are designed with a fixed opening rotation of 90°, with a mechanical stop. The actuators then close 90° to another mechanical stop. These actuators are not capable of freely spinning in both directions without mechanical impedance.

Additionally, the speed of travel of electrical actuators commonly on the market are too slow to generate the high spinning speeds needed for aggressive materials to be cleaned in the injector. Many electric actuators on the market operate at a maximum speed of only 1-2 rpm. Pneumatic solutions on the market are much faster acting, but do not offer freely spinning varieties.

Therefore, the actuator to power this feature of the present disclosure must be freely spinning in both directions, capable of low and high speeds, have position control in all positions, and be sufficiently robust to operate in continuous modulating duty paired with a steam injector. Though other types are contemplated, the preferred actuator is a servo driven model with planetary gear reducers to provide for either high torque or high speed (depending on the duty).

The much improved stem plug design of the present disclosure is an I-beam construction to provide high strength, which prevents warping at high steam pressures, without restricting steam flow to the injector nozzles. The internal radii of the C-chambers formed as part of the stem plug also provide for fluid turbulence during cleaning. Additionally, the main seals have been removed from the face of the stem plug and moved to the stem base. This provides a clear pathway for steam and cleaning fluids without impedance.

At the base of the C-chambers are two profiled foils. These profiled foils create either lifting or pushing pressures, depending on the spinning direction of the stem plug. The foils act and function as a pump to increase cleaning fluid turbulence within the steam injector. This action aids the C-chamber generated turbulence in the injector and provides very effective cleaning of any food or beverage residues at piping flowrates less than 1.5 m/s.

In addition to the turbulence of the cleaning solution inside the injector, the leading edges of both the C-chamber and the foils act to physically cut and dislodge food materials that may have built-up inside the injector to aid the cleaning process. This is especially critical in food processing applications with high protein containing materials, like egg, or have protein-carbohydrate complexes that form Maillard reactions. Physically dislodging the residue build-up and then generating high turbulence very effectively cleans the injector.

The procedure of freely spinning the head of the stem plug 360° has an effect on the cleaning process. Faster spinning adds more mechanical energy through physical contact and turbulent cleaning solution action, though draws more electrical energy. Slower spinning consumes less power, but provides less mechanical energy.

A servo actuator has the ability to spin at high speed, stop, switch directions, and achieve high spin rates in reverse. This action can be repeated any number of times.

Through the combination of these features, the injector with the paired servo actuator can achieve a balance between power consumption and cleaning action to meet any number of challenging food residues to provide a clean injection system.

All direct steam injectors currently on the market for 3-A leak steam during processing. This is due to very stringent restrictions from the 3-A authority that define and prevent double sealing faces and areas in an injector where food may become trapped without a method for cleaning.

This steam leak presents a unique challenge in the design of a steam injection heater due to the fact that food must be present in the process line before steam is pressurized. This food, and corresponding liquid pressure, always forces the liquid from the food into the steam chamber of the injector.

A two-step innovation of the present disclosure has been developed to minimize this issue to insignificance. The first step is to reduce the steam leak in a means that is acceptable to 3-A. For example, there must be some gap between the steam injector diffuser wall and the stem plug. If there were no gap, the diffuser would not be able to be assembled and even if it were pressed into the diffuser, it would not be able to be actuated. The larger the gap the easier assembly and actuation become, but the more steam leaks from the injector when it is fully closed. The solution to this issue is through the use of a bearing grade thermoplastic meeting 3-A requirements. PEEK is such a material and through the incorporation of energizing O-rings, the specially designed PEEK seal inserts can be easily assembled and actuated.

These seal inserts can press against the internal surface of the diffuser and reduces the gap between the stem plug and diffuser in the range of 85%. Additionally since PEEK grows when heated (during steam cooking), the gaps reduces to around 96%. This effectively reduces the steam leak to a low enough level that the injector can temperature control to very low flowrates. An added benefit of this design is that it prevents the vast majority of food liquids from entering the injector's steam chamber, which reduces cleaning times and increases cleaning efficiencies.

This is even more beneficial when paired with the second innovation in the design of the 360° freely spinning stem plug to create high velocities for cleaning the steam chamber during CIP.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
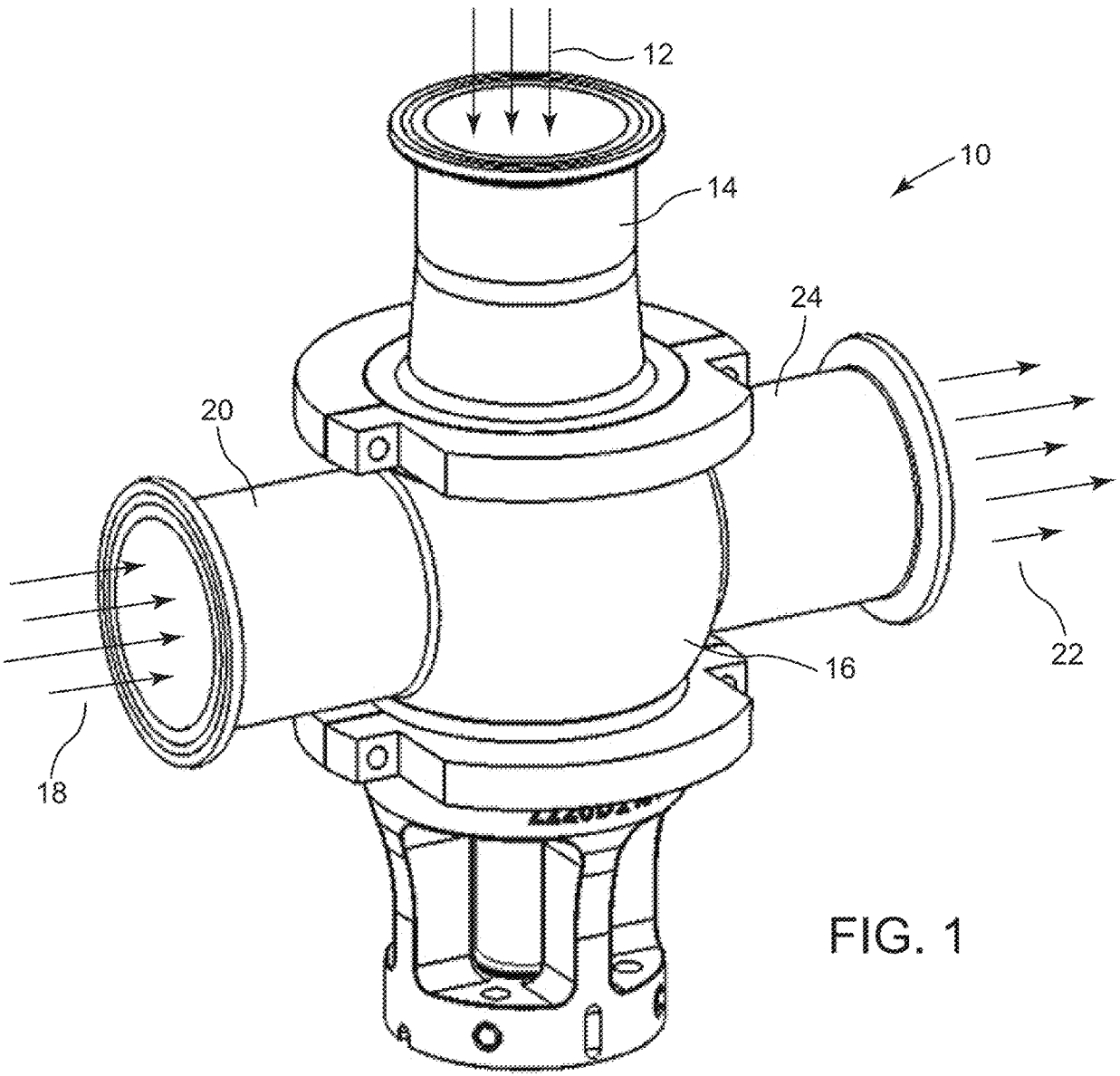
FIG. 1 is a perspective view of a steam injection heater incorporating the features of the present disclosure.

FIG. 1 illustrates a steam injection heater 10 constructed in accordance with the present disclosure. The steam injection heater 10 receives an inflow of steam 12 at a steam inlet 14. The flow of steam 12 passes into a main body 16 where the flow of steam is regulated and heats an inlet product flow 18 that enters into the main body 16 through a product inlet 20. When the inlet product flow 18 is within the main body 16, the inlet product flow 18 mixes with the steam 12 such that a heated product flow 22 leaves the body through a product outlet 24. The steam injection heater 10 shown in FIG. 1 is an improvement and enhancement of the Infuze cooker commercially available from Hydro-Thermal Corporation. The improvement will be described in detail below with reference to the drawing figures.

Figure 2:
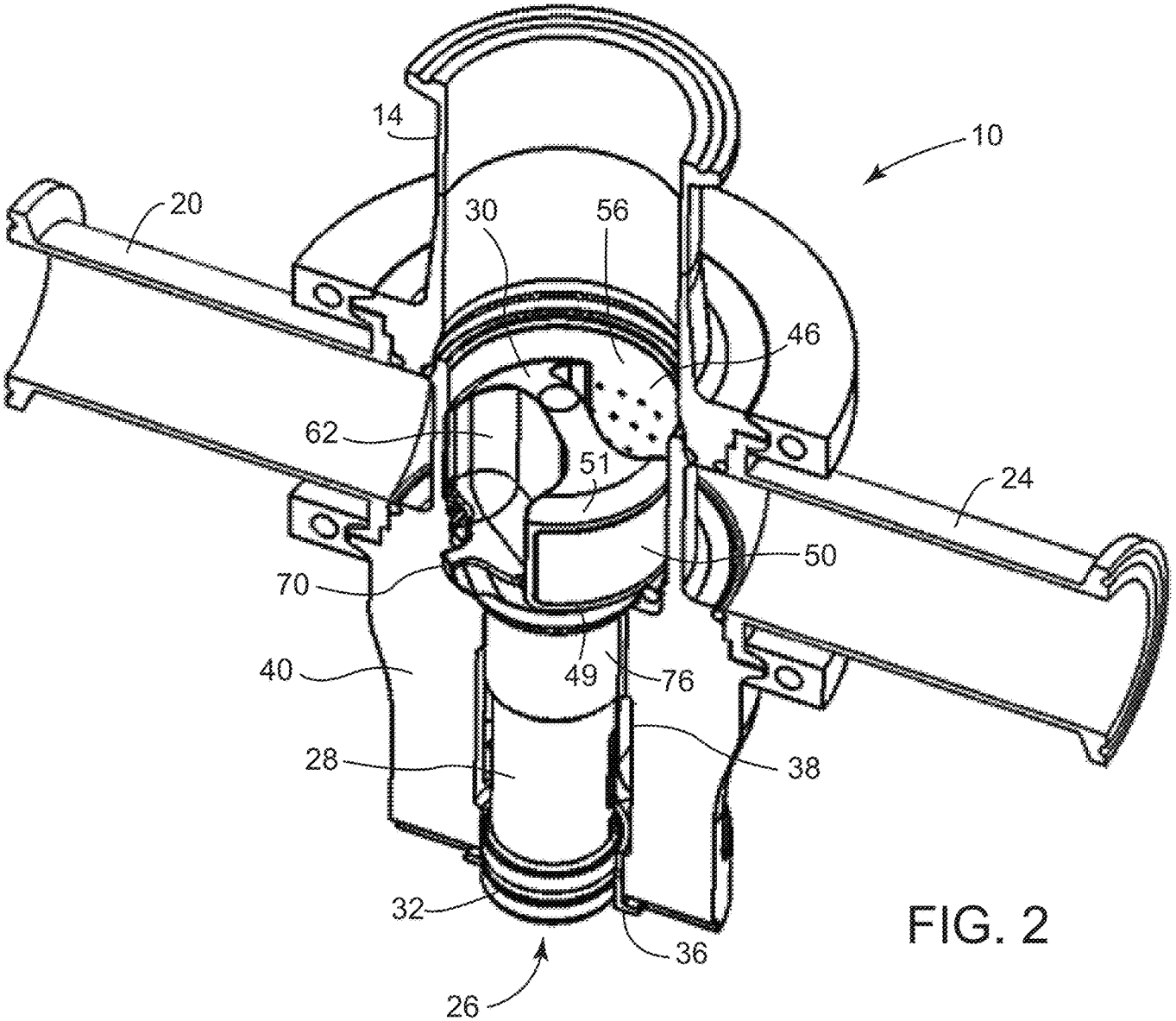
FIG. 2 is a section view of the steam injection heater shown in FIG. 1.

FIG. 2 is a section view of the steam injection heater 10 that shows the stem plug 26. The stem plug 26 includes a stem 28 and a regulating head 30. The stem 28 includes a seal bearing 76 that allows the entire stem plug 26 to rotate within the stationary mounting cage 40. The stem plug 26 further includes a profile 32 that engages a sleeve bearing 36 positioned within a cylindrical cavity 38 formed in the mounting cage 40. As can best be seen in FIG. 3, the mounting cage 40 includes a steam control portion 42 that includes two discharge sections 44 (only one shown) that allow steam to pass from the steam chamber 46 out into the product flow that passes around the steam control portion 42. The discharge sections 44 are spaced from each other on the steam control portion 42 and each includes a series of steam nozzles 48 specifically distributed within the discharge section 44.

Figure 3:
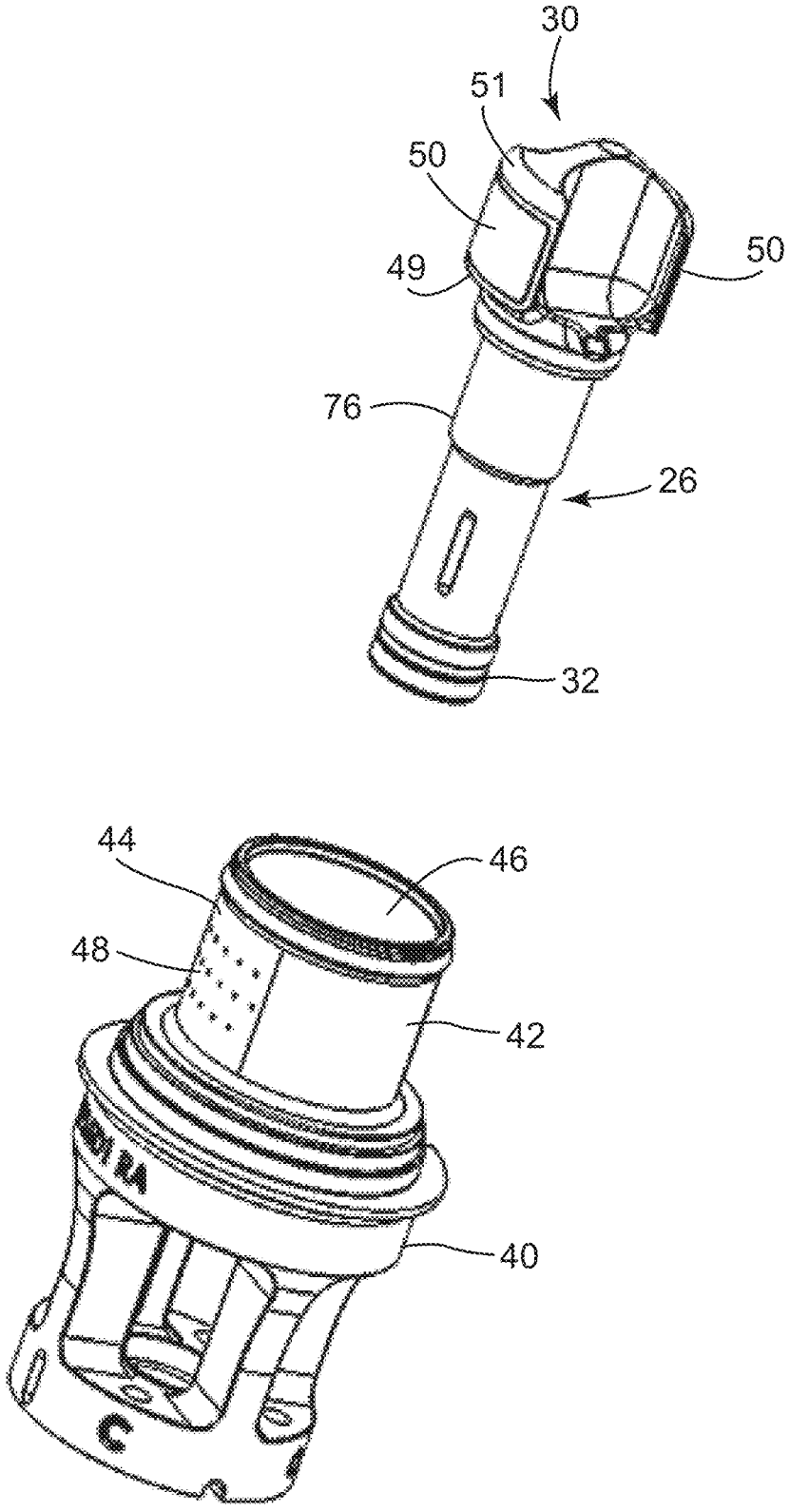
FIG. 3 is a partially exploded view of the control components of the steam injection heater.
Figure 5:
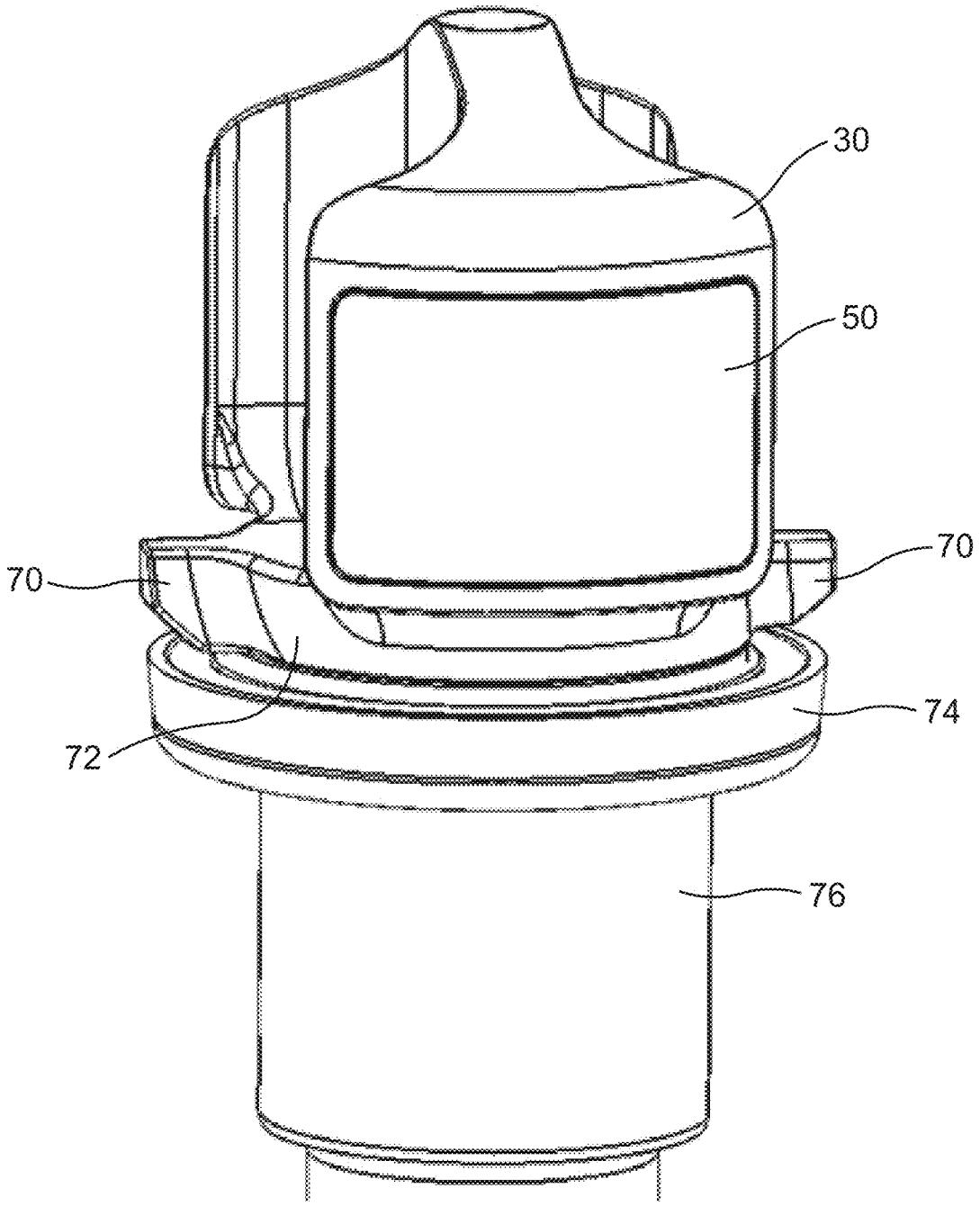
FIG. 5 is a perspective view showing the components of the stem plug used for both sealing and cleaning.

As can be seen in FIGS. 2 and 3, the regulating head 30 of the stem plug 26 includes a pair of outer faces 49 that are curved to match the curved inner surface of the steam chamber 46 formed in the steam control portion 42. In the embodiment illustrated, the outer faces 49 each include a sealing insert 50 formed on the modulating portion 51 of the regulating head 30. As shown in FIG. 5, the sealing insert 50 is a generally rectangular area that has a size slightly larger than the area of the discharge section 44. Thus, when the sealing insert 50 is aligned with the discharge section 44, the sealing insert 50 is large enough to cover all of the steam nozzles 48 to prevent steam from flowing into the product flow. As the stem plug 26 rotates, the sealing insert 50 begins to uncover some of the nozzles 48 to modulate the amount of steam that enters into the product flow, thereby controlling the heating of the product flow. In this manner, a control system and associated actuator can accurately control the temperature of the product flow leaving the steam injection heater through the product outlet 24.

In the embodiment shown in the drawing figures, the sealing insert 50 is formed from a bearing grade thermoplastic material that meets the 3-A requirements. PEEK is such a thermoplastic material. In the embodiment illustrated, energizing O-rings are used to urge the sealing insert 50 outward to create the required seal with the steam control portion 42. In the embodiment illustrated, the specially designed PEEK sealing inserts 50 can be easily assembled and actuated. The sealing inserts 50 create a seal with the inner surface 56 of the steam control portion 42 such that when the sealing insert 50 is aligned with the discharge section 44, the sealing insert 50 largely prevents the discharge of steam into the product flow.

Figure 4:
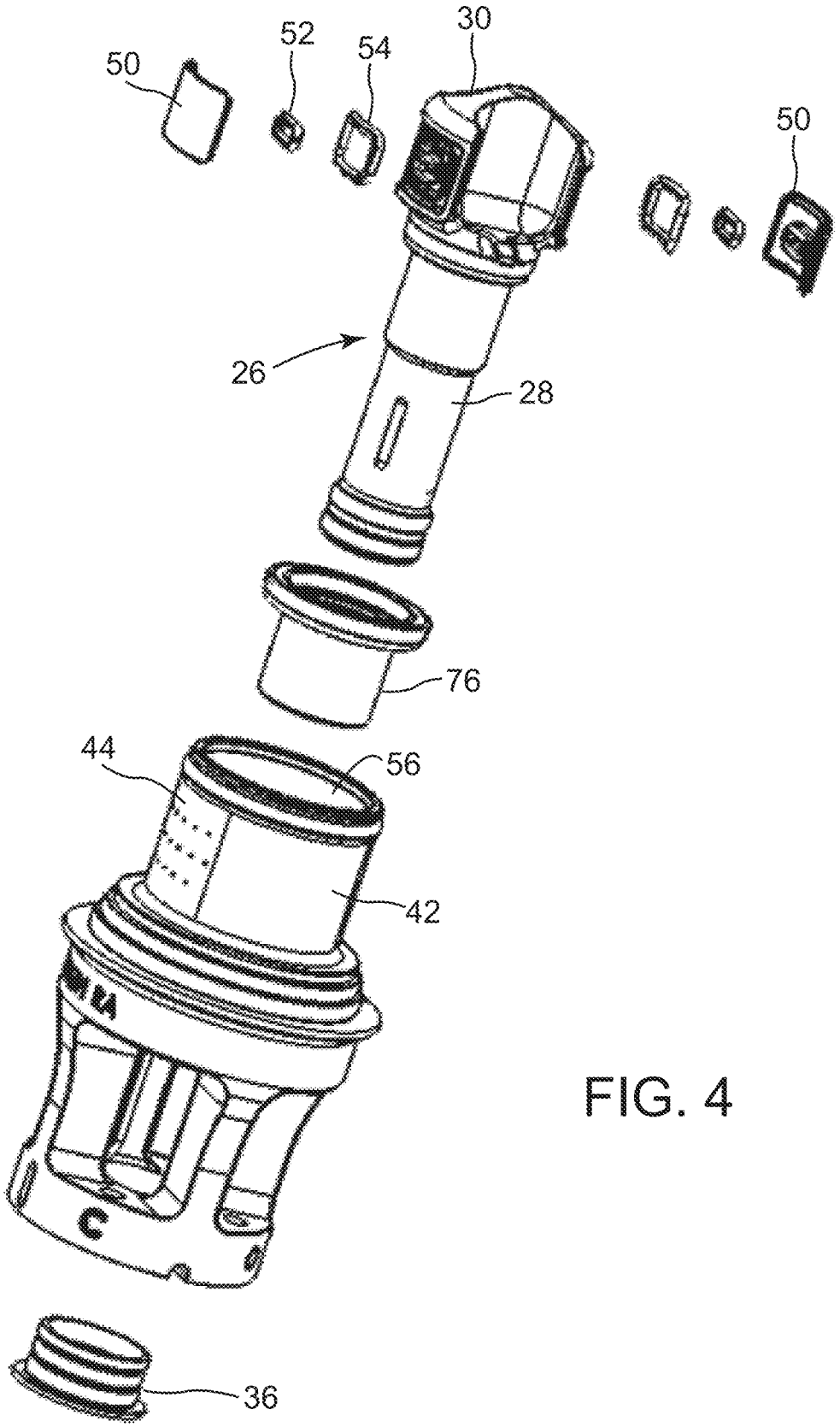
FIG. 4 is an exploded view of the components of FIG. 3.

Referring now to FIG. 4, each of the sealing inserts 50 is mounted to the regulating head 30 by an inner bias member 52 and an outer bias member 54. The inner and outer bias members 52, 54 create an outward force on the sealing insert 50 such that the sealing insert 50 is urged into contact with the inner surface 56 of the steam control portion 42 to create a fluid tight seal such that the sealing insert 50 largely prevents the undesired discharge of steam from within the discharge section 44. In one embodiment of this disclosure, the bias members 52, 54 are elastic material, although other materials are contemplated as being within the scope of the present disclosure.

As can be understood by the drawing figures, the material that forms the sealing insert 50 creates the fluid tight seal between the modulating portion 51 of the regulating head 30 and the inner surface 56. Each of the sealing inserts 50 can be removed from the regulating head 30 and replaced when worn.

Figure 6:
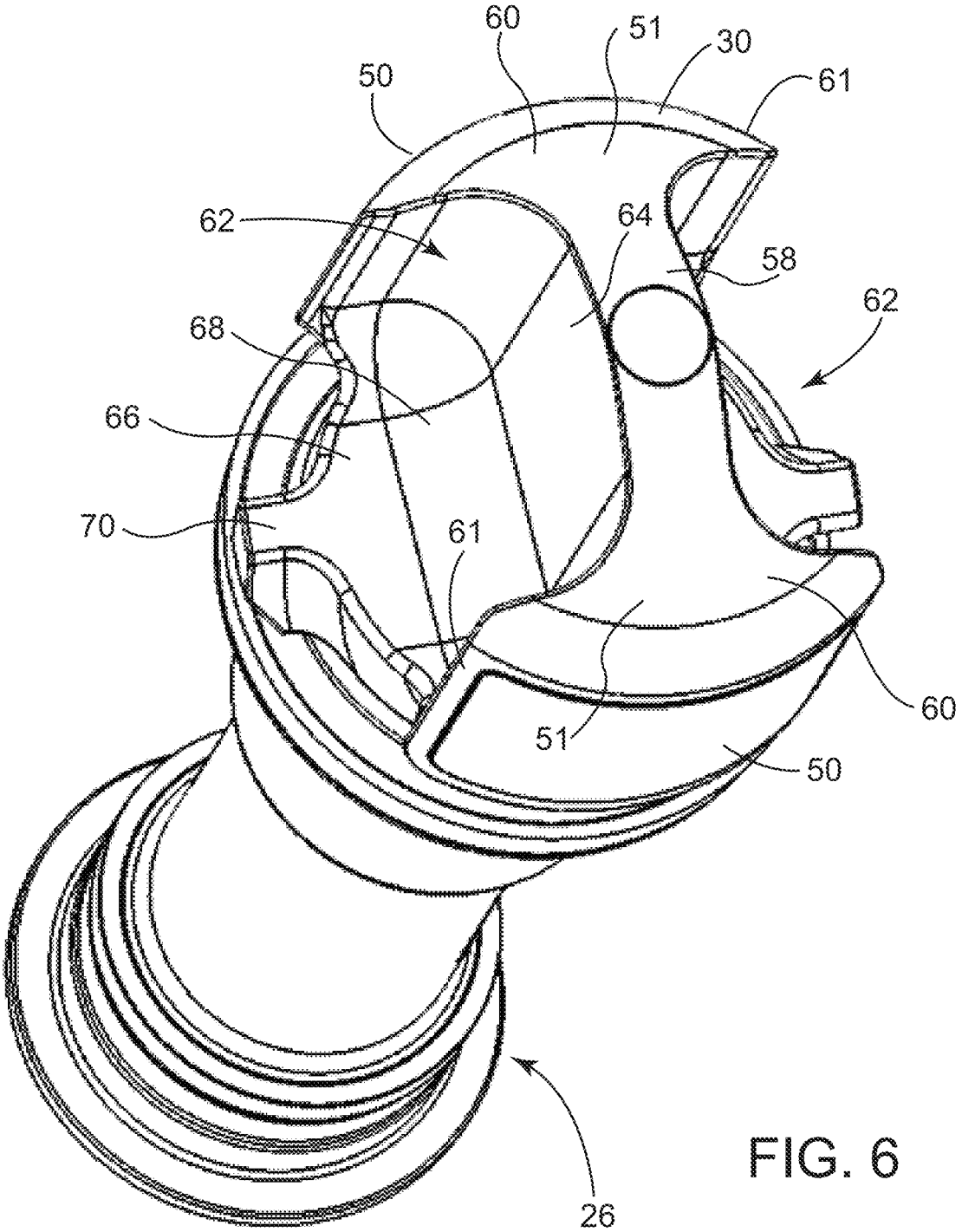
FIG. 6 is a top perspective view of the regulating head of the stem plug.
Figure 7:
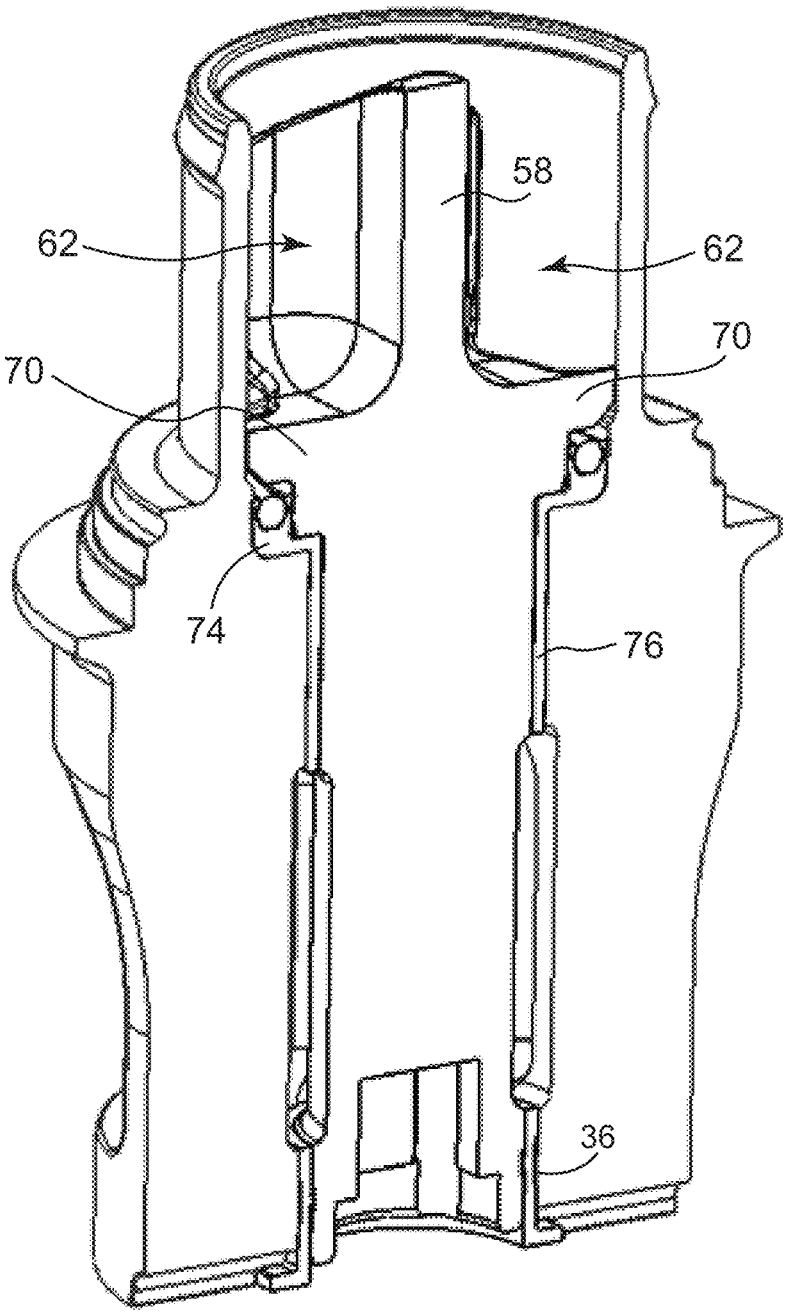
FIG. 7 is a section view showing the position of the stem plug within the mounting cage.

Referring now to the top view of FIG. 6, the regulating head 30 has an I-beam configuration when viewed from the top and includes a center beam 58 that extends between the pair of side walls 60 that are includes as part of the modulating portions 51. Each of the side walls 60 includes a curved outer wall 61 that defines the mounting area for one of the two sealing inserts 50. Between the side walls 60 of the modulating portions 51 are a pair of C-shaped chambers 62 that each are formed by a back wall 64 and a bottom wall 66. The back wall 64 and bottom wall 66 are joined by a curved transition area 68 that defines a generally C-shaped chamber. As illustrated in FIG. 6, the bottom wall 66 includes a profiled foil 70. The profiled foil 70 extends from the bottom wall 66 and has a thickness defined along the longitudinal axis of the stem plug 26. As can be seen in FIGS. 5 and 7, the profiled foils 70 extend from the otherwise circular bottom wall 72 of the regulating head 30. The profiled foils 70 have a shape and thickness to emulate the vanes of a pump and are configured to circulate liquid during a clean in place (CIP) process for the steam injection heater.

As illustrated in FIGS. 5 and 7, the pair of profiled foils 70 extends above the top rim 74 of a bearing seal 76. The bearing seal 76 is used to rotationally support the stem plug 26 and specifically the regulating head 30 during use, as well as sealing the stem 28 and the inner surface 56 from the exterior of the heater.

Figure 8:
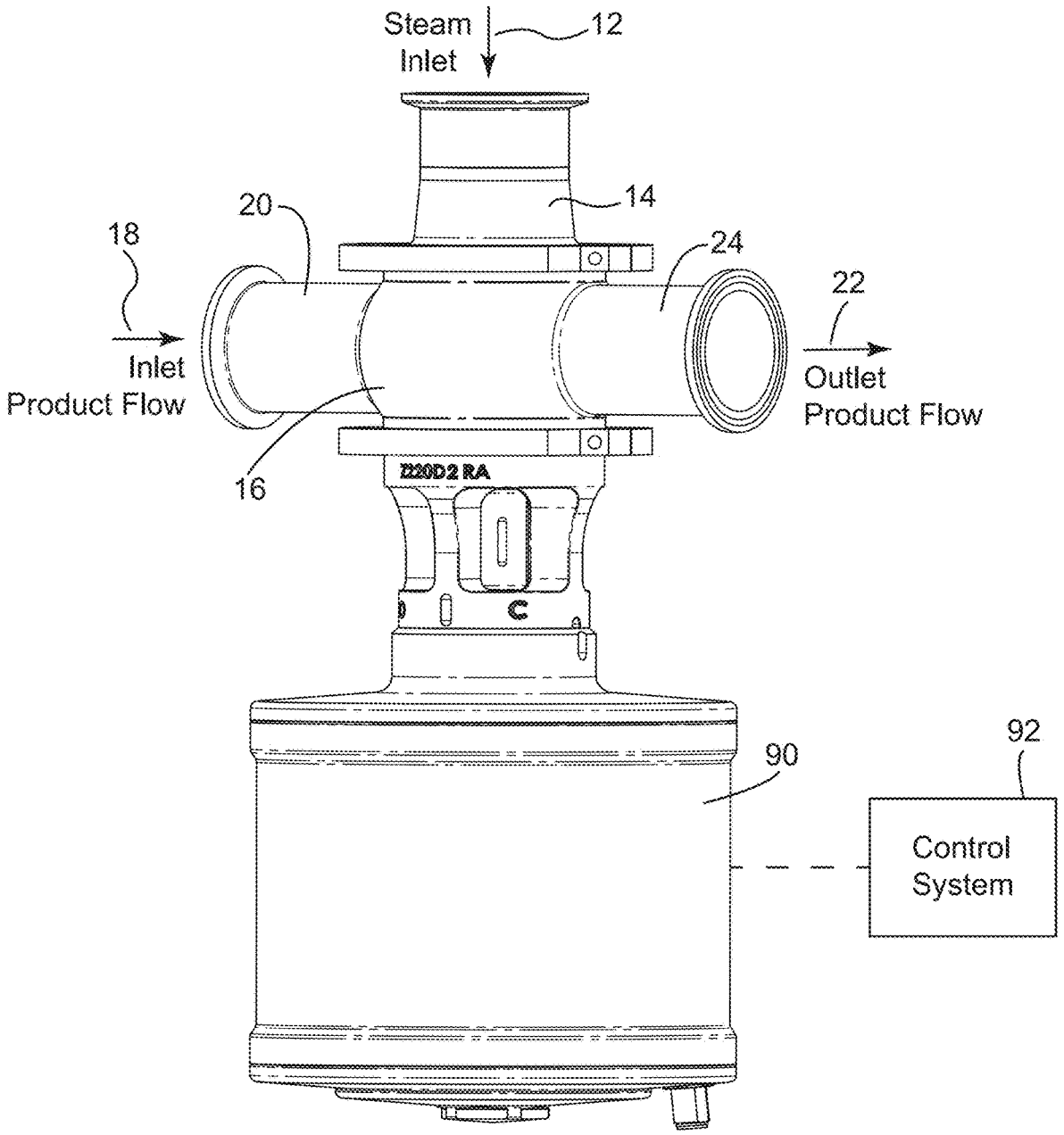
FIG. 8 is a schematic illustration of a heating system including the steam injection heater.

As best shown in FIGS. 2 and 8, during normal operation of the steam injection heater to heat the product flow 18, a flow of steam 12 is provided to the steam inlet 14. An actuator 90 and control system 92 control the position of the stem plug 26, and specifically the position of the sealing insert 50 relative to the steam nozzles 48 formed in the discharge section 44. By uncovering more or less steam nozzles, the control system 92 and actuator 90 can control the amount of steam injected into the product flow to create the desired amount of heating of the product flow. As discussed previously, the sealing insert 50 creates a seal over the entire discharge section 44 in the closed position and rotation of the stem plug and regulating head 30 away from the closed position uncovers an increasing number of steam holes to increase the amount of steam injected into the product flow. The sealing insert 50 is biased against the inner surface 56 along the discharge section 44 to accurately control the amount of steam injected.

During cleaning, the flow of steam 12 is interrupted and a cleaning fluid is introduced in place of the steam flow. When the cleaning fluid flows into the steam chamber 46 from the steam inlet 14, the actuator 90 of the present disclosure operates to rotate the regulating head 30 though a full 360° rotation at a sufficient speed. As discussed above, the actuator 90 is designed to allow 360° rotation of the stem plug 26 as compared to prior steam injection heaters in which the stem plug rotates only 90°.

During the 360° repeating rotation of the stem plug 26 during CIP, the profiled foils 70, in conjunction with the C-shaped chambers 62, create a high velocity turbulent flow of the cleaning fluid within the steam chamber 46, even with piping flow rates less than 1.5 m/s. The profiled foils 70 thus act as a "pump" and circulate the cleaning fluid within the steam chamber 46 to enhance the CIP process.

The actuator 90 is connected to the stem plug 26 such that the stem plug is freely spinning in both directions, capable of low and high speeds, has position control in all positions, and be sufficiently robust to operate in continuous modulating duty paired with a steam injector. Though other types are contemplated, the preferred actuator 90 is a servo driven model with planetary gear reducers to provide for either high torque or high speed (depending on the duty).

Although the actuator 90 is shown in the drawing figures as being used with a direct contact steam injection heater that includes the stem plug and regulating head, the 360° actuator could be used in other applications that include an element that controls the flow of a liquid or fluid. For example, a quarter turn actuator that is used in other types of systems that include flow control elements could be replaced by the 360° actuator of the present disclosure.

In such an alternate embodiment, the actuator would be used in a manner similar to a quarter turn actuator to control the movement of the flow control element between open and closed positions during normal operation. If the system needs to be cleaned, the 360° actuator could then be used to rotate the flow control device over a complete 360° rotation. During this 360° rotation, features on the flow control device would distribute a cleaning fluid around the body to help clean the body.

In one specific example of an alternate embodiment, the flow control device could be a butterfly valve that includes a valve disc movable in a valve body. During normal operation, the actuator rotates the valve disc 90° between open and closed positions. In a cleaning processes, the actuator would rotate the valve disc 360° at an acceptable speed while a cleaning fluid or solution is passed through the valve. In this manner, replacement of the quarter turn actuator with the 360° actuator allows the valve to operate in a normal manner and also be used in a cleaning or flushing mode.

What is claimed is:

1. A direct contact steam injection heater, comprising:

a heater body having a steam inlet, a product inlet, and a heated product outlet;

a mounting cage received within the heater body, the mounting cage including a steam chamber located in communication with the steam inlet;

a pair of steam discharge sections each having a plurality of nozzles to allow the flow of steam out of the steam chamber;

a stem plug rotatably positioned within the mounting cage, the stem plug including a regulating head and a stem;

a pair of sealing faces formed on the regulating head, wherein each of the sealing faces is sized to cover one of the steam discharge sections when the regulating head is in a closed position;

an actuator connected to the stem plug and operable to rotate the stem plug over a full 360° rotation; and a control unit operable to control the actuator to selectively rotate the regulating head from a closed position to an open position to control the amount of steam flowing out of the steam chamber.

2. The direct contact steam injection heater of claim 1 wherein the sealing face includes a removable sealing insert.

3. The direct contact steam injection heater of claim 2 wherein the sealing insert is formed from a thermoplastic material.

4. The direct contact steam injection heater of claim 3 wherein the sealing insert is formed from PEEK.

5. The direct contact steam injection heater of claim 2 further comprising a bias member positioned between the sealing insert and the regulating head to bias the sealing insert radially outward from the regulating head.

6. The direct contact steam injection heater of claim 1 wherein the regulating head includes a pair of recessed chambers each formed from a back wall and a bottom wall, wherein each of the recessed chambers are located between the pair of sealing faces.

7. The direct contact steam injection heater of claim 6 wherein the back walls of the pair of recessed chambers are separated by a center beam and the pair of sealing faces are connected to the center beam.

8. The direct contact steam injection heater of claim 6 further comprising a pair of foils each extending from the bottom wall of one of the recessed chambers.

9. The direct contact steam injection heater of claim 8 wherein each of the pair of foils are configured to create turbulent flow of a cleaning liquid when the stem plug rotates over the full 360° of rotation.

10. The direct contact steam injection heater 8 wherein each of the pair of foils extends radially outward from the bottom wall.

11. A direct contact steam injection heater, comprising:

a heater body having a steam inlet, a product inlet, and a heated product outlet;

a mounting cage received within the heater body, the mounting cage including modulating portion that defines a steam chamber located in communication with the steam inlet;

a pair of steam discharge sections formed in the modulating portions and each having a plurality of nozzles to allow the flow of steam out of the steam chamber;

a stem plug rotatably positioned within the mounting cage, the stem plug including a regulating head and a stem;

a pair of sealing faces formed on the regulating head, wherein each of the sealing faces includes a sealing insert sized to cover one of the steam discharge sections when the regulating head is in a closed position;

a pair of recessed chambers included on the regulating head, each recessed chamber being formed from a back wall and a bottom wall, wherein each of the recessed chambers are located between the pair of sealing faces;

a pair of foils each extending from the bottom wall of one of the recessed chambers an actuator connected to the stem plug and operable to rotate the stem plug over a full 360° rotation; and a control unit operable to control the actuator to selectively rotate the regulating head from a closed position to an open position to control the amount of steam flowing out of the steam chamber.

12. The direct contact steam injection heater of claim 11 wherein the sealing insert is formed from a thermoplastic material.

13. The direct contact steam injection heater of claim 12 wherein the sealing insert is formed from PEEK.

14. The direct contact steam injection heater of claim 11 further comprising a bias member positioned between the sealing insert and the regulating head to bias the sealing insert radially outward from the regulating head.

15. The direct contact steam injection heater of claim 14 wherein the back walls of the pair of recessed chambers are separated by a center beam and the pair of sealing faces are connected to the center beam.

16. The direct contact steam injection heater of claim 11 wherein each of the pair of foils are configured to create turbulent flow of a cleaning liquid when the stem plug rotates over the full 360° of rotation.

17. The direct contact steam injection heater 16 wherein each of the pair of foils extends radially outward from the bottom wall.

* * * * *